US009677349B2

(12) United States Patent
Ireland et al.

(10) Patent No.: US 9,677,349 B2
(45) Date of Patent: Jun. 13, 2017

(54) DOWNHOLE ENTRY GUIDE HAVING DISAPPEARING PROFILE AND METHODS OF USING SAME

(71) Applicant: Baker Hughes Incorporated, Houston, TX (US)

(72) Inventors: Kelly D. Ireland, Conroe, TX (US); Timothy L. Cragin, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 623 days.

(21) Appl. No.: 13/922,716

(22) Filed: Jun. 20, 2013

(65) Prior Publication Data

US 2014/0374121 A1 Dec. 25, 2014

(51) Int. Cl.

| | |
|---|---|
| ***E21B 17/10*** | (2006.01) |
| ***E21B 29/00*** | (2006.01) |
| ***E21B 29/02*** | (2006.01) |

(52) U.S. Cl.

CPC ..... *E21B 17/1078* (2013.01); *E21B 29/00* (2013.01); *E21B 29/02* (2013.01)

(58) Field of Classification Search

CPC ..... E21B 17/1078; E21B 29/00; E21B 31/16; E21B 31/002; E21B 29/02; E21B 19/24

See application file for complete search history.

(56) References Cited

U.S. PATENT DOCUMENTS 1,904,317 A * 4/1933 Larkin ..... E21B 17/14 137/541
3,211,232 A 10/1965 Grimmer
4,537,255 A 8/1985 Regalbuto et al.
4,949,788 A 8/1990 Szarka et al.
4,991,654 A 2/1991 Brandell et al.
5,333,689 A 8/1994 Jones et al.
5,479,986 A 1/1996 Gano et al.
5,501,276 A 3/1996 Weaver et al.
5,558,153 A 9/1996 Holcombe et al.
5,607,017 A 3/1997 Owens et al.
5,623,993 A 4/1997 Van Buskirk et al.
5,685,372 A 11/1997 Gano (Continued)

OTHER PUBLICATIONS

D.W. Thomson, et al., Design and Installation of a Cost-Effective Completion System for Horizontal Chalk Wells Where Multiple Zones Require Acid Stimulation, SPE Drilling & Completion, Sep. 1998, pp. 151-156, Offshore Technology Conference, U.S.A.

(Continued)

*Primary Examiner* — Nicole Coy

(74) *Attorney, Agent, or Firm* — Parson Behle & Latimer

(57) ABSTRACT

Entry guides for use on a tubing string comprise one or more dissolvable materials. A profile disposed on the entry guide facilitates aligning the tubing string in a desired orientation within a wellbore. For example, the profile can align the tubing string with a bore of a component disposed within the wellbore so that the tubing string can be inserted into a bore of the downhole component. After proper alignment has been achieved, the one or more dissolvable materials can be activated to disappear leaving behind the tubing string and the downhole component in their desired arrangement. One or more portion of the entry guides, including the profile, can be formed out of the dissolvable material.

20 Claims, 3 Drawing Sheets

(56) References Cited

U.S. PATENT DOCUMENTS

| | | | | |
|---|---|---|---|---|
| 5,709,269 | A | 1/1998 | Head | |
| 5,765,641 | A | 6/1998 | Shy et al. | |
| 6,026,903 | A | 2/2000 | Shy et al. | |
| 6,062,310 | A | 5/2000 | Wesson et al. | |
| 6,076,600 | A | 6/2000 | Vick, Jr. et al. | |
| 6,161,622 | A | 12/2000 | Robb et al. | |
| 6,220,350 | B1 | 4/2001 | Brothers et al. | |
| 6,289,991 | B1 | 9/2001 | French | |
| 6,397,950 | B1 | 6/2002 | Streich et al. | |
| 6,431,276 | B1 | 8/2002 | Robb et al. | |
| 6,926,086 | B2 | 8/2005 | Patterson et al. | |
| 7,093,664 | B2 | 8/2006 | Todd et al. | |
| 7,325,617 | B2 | 2/2008 | Murray | |
| 7,350,582 | B2 | 4/2008 | McKeachnie et al. | |
| 7,353,879 | B2 * | 4/2008 | Todd | E21B 23/00 166/317 |
| 7,395,856 | B2 | 7/2008 | Murray | |
| 7,395,882 | B2 * | 7/2008 | Oldham | E21B 7/20 166/242.8 |
| 7,464,764 | B2 | 12/2008 | Xu | |
| 7,490,677 | B2 | 2/2009 | Buytaert | |
| 7,625,846 | B2 | 12/2009 | Cooke, Jr. | |
| 7,628,210 | B2 | 12/2009 | Avant et al. | |
| 7,644,772 | B2 | 1/2010 | Avant et al. | |
| 7,878,253 | B2 | 2/2011 | Stowe et al. | |
| 8,113,290 | B2 | 2/2012 | Sharma | |
| 8,413,727 | B2 | 4/2013 | Holmes | |
| 2003/0141064 | A1 | 7/2003 | Roberson, Jr. | |
| 2003/0168214 | A1 | 9/2003 | Sollesnes | |
| 2005/0092363 | A1 | 5/2005 | Richard et al. | |
| 2005/0161224 | A1 * | 7/2005 | Starr | E21B 33/134 166/376 |
| 2005/0205264 | A1 | 9/2005 | Starr et al. | |
| 2005/0205265 | A1 | 9/2005 | Todd et al. | |
| 2005/0205266 | A1 | 9/2005 | Todd et al. | |
| 2005/0281968 | A1 | 12/2005 | Shanholtz et al. | |
| 2006/0021748 | A1 | 2/2006 | Swor et al. | |
| 2006/0131031 | A1 | 6/2006 | McKeachnie et al. | |
| 2006/0266518 | A1 | 11/2006 | Woloson | |
| 2007/0023190 | A1 | 2/2007 | Hall | |
| 2007/0074873 | A1 | 4/2007 | McKeachnie et al. | |
| 2008/0066923 | A1 | 3/2008 | Xu | |
| 2008/0066924 | A1 | 3/2008 | Xu | |
| 2009/0044948 | A1 | 2/2009 | Avant et al. | |
| 2009/0107684 | A1 | 4/2009 | Cooke, Jr. | |
| 2010/0032151 | A1 | 2/2010 | Duphorne | |
| 2010/0252273 | A1 | 10/2010 | Duphorne | |
| 2011/0132143 | A1 | 6/2011 | Xu et al. | |
| 2011/0132612 | A1 | 6/2011 | Agrawal et al. | |
| 2011/0132619 | A1 | 6/2011 | Agrawal et al. | |
| 2011/0132620 | A1 | 6/2011 | Agrawal et al. | |
| 2011/0132621 | A1 | 6/2011 | Agrawal et al. | |
| 2011/0135530 | A1 | 6/2011 | Xu et al. | |
| 2011/0135953 | A1 | 6/2011 | Xu et al. | |
| 2011/0136707 | A1 | 6/2011 | Xu et al. | |
| 2012/0024109 | A1 | 2/2012 | Xu et al. | |
| 2012/0255743 | A1 | 10/2012 | Oxford | |
| 2012/0292053 | A1 | 11/2012 | Xu | |
| 2014/0076571 | A1 * | 3/2014 | Frazier | E21B 43/26 166/308.1 |

OTHER PUBLICATIONS

H.A. Nasr-El-Din, et al., Laboratory Evaluation Biosealers, Feb. 13, 2001, pp. 1-11, SPE 65017, Society of Petroleum Engineers Inc., U.S.A.

X. Li, et al., An Integrated Transport Model for Ball-Sealer Diversion in Vertical and Horizontal Wells, Oct. 9, 2005, pp. 1-9, SPE 96339, Society of Petroleum Engineers, U.S.A.

International Search Report and Written Opinion dated Mar. 14, 2014 issued in PCT/US2013/062892.

* cited by examiner

DOWNHOLE ENTRY GUIDE HAVING DISAPPEARING PROFILE AND METHODS OF USING SAME

BACKGROUND

1. Field of Invention

The invention is directed to entry guides for aligning one downhole component relative to another downhole component within a wellbore and, in particular, to entry guides formed at least in part by a dissolvable material.

2. Description of Art

Entry guides such as mule shoes are generally known in the art. In typical arrangement, the mule shoe is attached to the bottom of a downhole casing or tubing string that is run-in a wellbore. The purpose of the mule shoe is to guide the tubing string into the bore of another downhole component already in place within the wellbore. Because the bore of the downhole component already in place in the wellbore is smaller than the diameter of the wellbore, there is a transition from the inner wall surface or inside diameter of the wellbore to the inner wall surface or inside diameter of the downhole component already disposed in the wellbore. The function of the mule shoe is to provide a tapered surface to guide the tubing string attached to the mule shoe into the bore of the existing component disposed downhole. After insertion into the downhole component already in place within the wellbore, the bores of the two downhole components are in alignment such that remedial or other downhole operations can be performed through the bore of the tubing string and through the bore of the downhole component already in place within the wellbore.

SUMMARY OF INVENTION

Broadly, the entry guides disclosed herein are formed at least in part by a material capable of disappearing. In certain embodiments, the entry guides include a profile disposed on a lower end of the guides that facilitates insertion of the guide into a bore of a downhole component already disposed within the wellbore. All or part of the guide is formed out of the dissolvable material such that, in one specific embodiment, after the tubing string is inserted into the bore of the downhole component already disposed in the wellbore, all or part of the guide dissolves.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
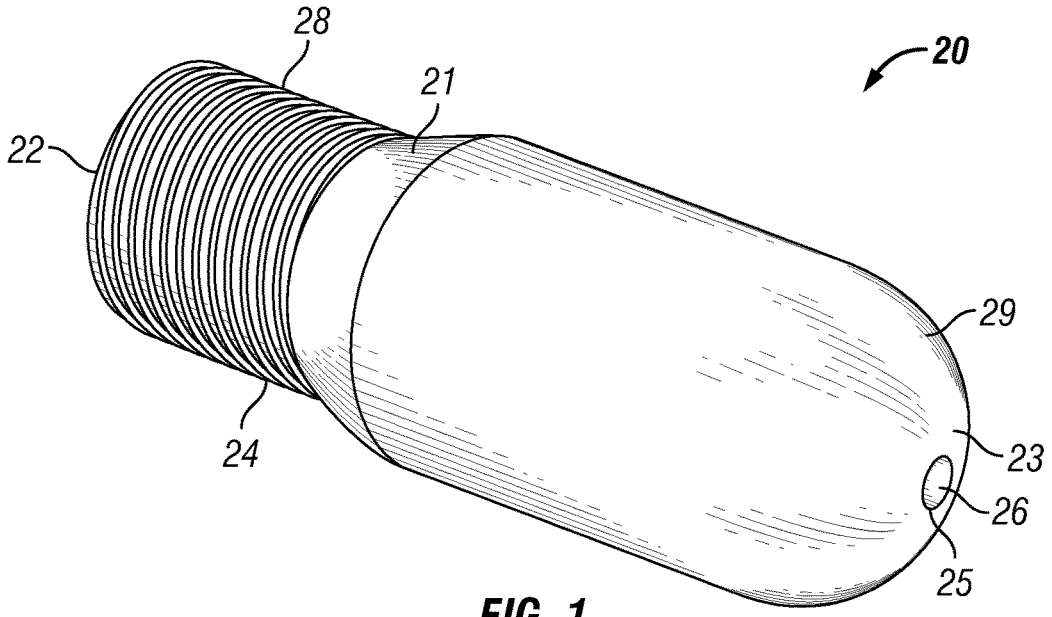
FIG. 1 is a perspective view of a specific embodiment of an entry guide disclosed herein.
Figure 2:
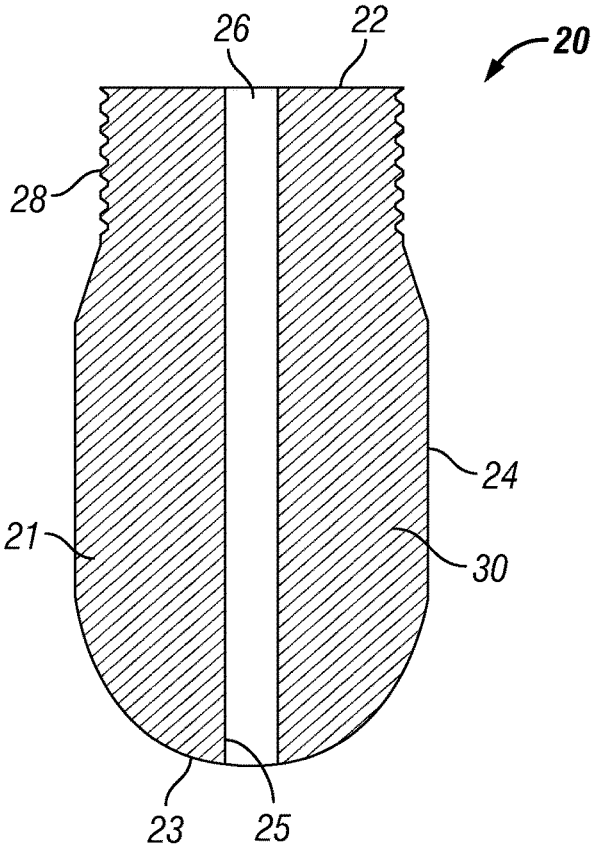
FIG. 2 is a cross-sectional view of the entry guide shown in FIG. 1.
Figure 3:
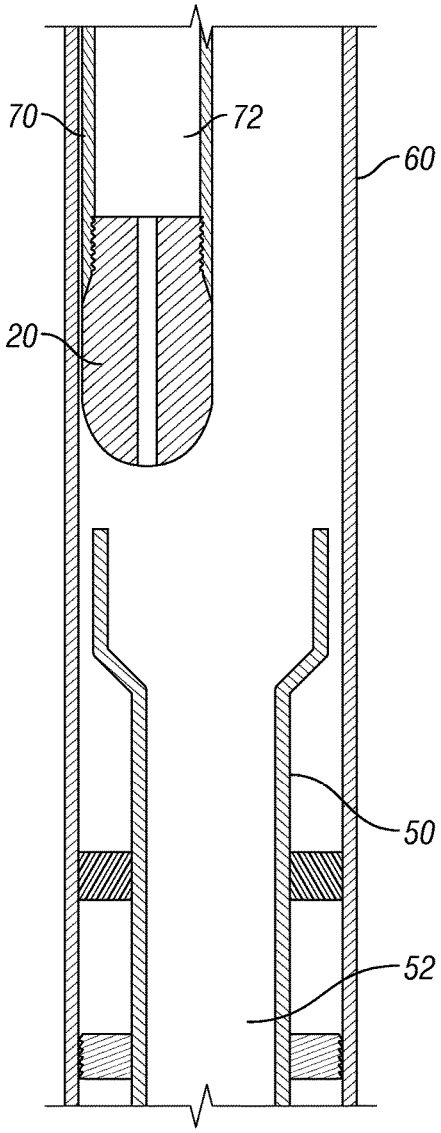
FIG. 3 is a cross-sectional view of the entry guide of FIG. 1 shown attached to a tubing string disposed in a wellbore prior to insertion into a downhole component.
Figure 4:
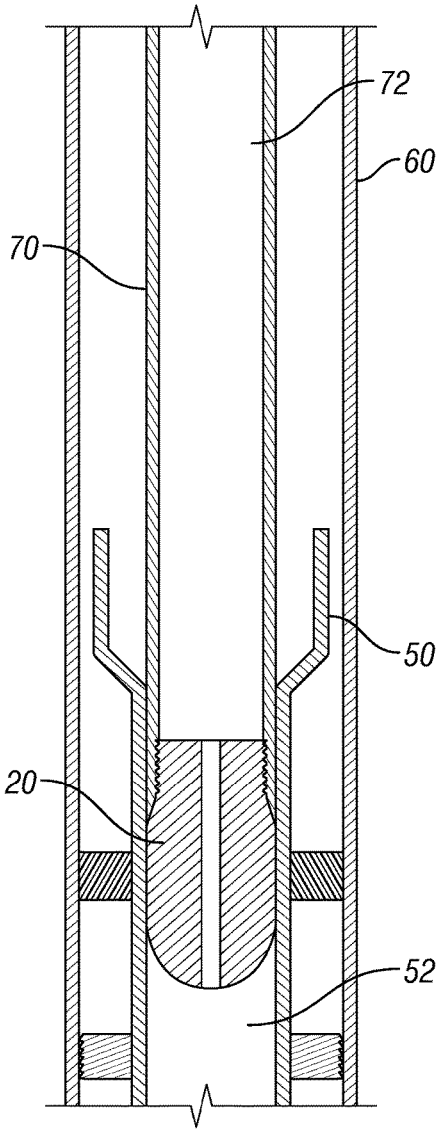
FIG. 4 is a cross-sectional view of the entry guide of FIG. 1 shown attached to a tubing string disposed in a wellbore after insertion into a downhole component.
Figure 5:
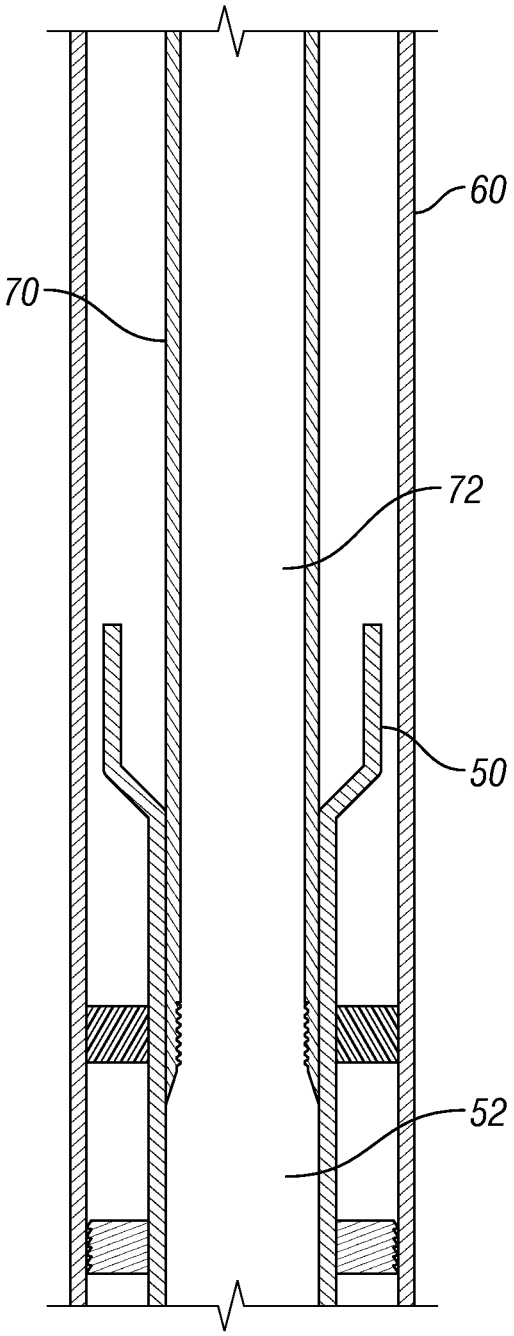
FIG. 5 is a cross-sectional view of the tubing string shown in FIGS. 3-4 after the downhole entry guide of FIG. 1 has completely disappeared.

Referring now to FIGS. 1-2, in one specific embodiment, entry guide 20 comprises body 21 having upper end 22, lower end 23, outer wall surface 24, and longitudinal bore 26 defined by inner wall surface 25. Toward upper end 22, outer wall surface 24 includes one or more fasteners such as threads 28 to facilitate attaching entry guide 20 to casing or tubing string 70 (FIGS. 3-5).

Lower end 23 includes a shape or profile 29 to facilitate insertion of guide 20 into a receptacle such as a bore of another component. As discussed in greater detail below, in one specific embodiment, profile 29 guides tubing string 70 into the desired opening of a downhole component disposed in the wellbore into which guide 20 is ultimately inserted by centralizing tubing string 70 and providing a low friction means of entry. As illustrated in FIGS. 1-5, entry guide 20 of this specific embodiment comprises a uniform shape such that regardless of the rotational orientation of guide 20, the same profile is presented to the component disposed within the wellbore into which guide 20 is ultimately inserted. One such uniform shape of profile 29 is hemispherical as illustrated in FIGS. 1-5.

In addition, all or part, e.g., upper end 22, lower end 23, inner wall surface 25, of guide 20 is formed of dissolvable material 30 (FIG. 2). In the embodiment of FIGS. 1-5, all of body 21 and, thus, entry guide 20, is formed of dissolvable material 30.

As used herein "dissolvable material" means that the material is capable of being corroded, dissolved, degraded, disintegrated or otherwise compromised by a stimulus such that it no longer retains its initial shape. Thus, dissolvable material 30 is initially designed to have a first or initial shape (FIGS. 1-4) and, as it is corroded or otherwise has its integrity compromised, it can no longer retain the initial shape. In certain embodiments, the dissolvable material 30 provides a second shape. In other words, not all of guide 20 is dissolved. In still other embodiments, such as the embodiment of FIGS. 1-5, guide 20 is formed completely out of dissolvable material 30 such that guide 20 is capable of being completely dissolved.

In addition, the dissolvable materials 30 described herein can be formed out of any material that is capable of being removed from the entry guide 20 such that all or part of entry guide 20 dissolves after entry guide 20 has performed its intended function, such as insertion of entry guide 20 into a downhole component already disposed within a wellbore. Thus, "dissolvable material" as used herein comprises any material capable of disappearing or being removed such as through application of temperature, pressure, contact with a fluid, being combusted, being exploded, or being broken up. "Dissolvable" is understood to encompass the terms, but not be limited to the terms, dissolvable, degradable, combustible, and disintegrable as well as materials that are capable of being "removed," "degraded," "combusted," "fractured," "detonated," "deflagrated," "disintegrated," "degradation," "combustion," "explosion," and "disintegration."

Suitable dissolvable materials 30 for forming all or part of guide 20 include, but are not limited to materials such as those disclosed and described in U.S. Patent Publication No. 2010/0252273 filed in the name of Duphorne, U.S. Patent Publication No. 2011/0132620 filed in the name of Agrawal, et al., U.S. Patent Publication No. 2011/0132619 filed in the name of Agrawal, et al., U.S. Patent Publication No. 2011/0132621 filed in the name of Agrawal, et al., U.S. Patent Publication No. 2011/0136707 filed in the name of Xu, et al., U.S. Patent Publication No. 2011/0132612 filed in the name of Agrawal, et al., U.S. Patent Publication No. 2011/0135953 filed in the name of Xu, et al., U.S. Patent Publication No. 2011/0135530 filed in the name of Xu, et al., U.S. Patent Publication No. 2012/0024109 filed in the name of Xu, et al., and U.S. Patent Publication No. 2012/0255743 filed in the name of Oxford, each of which is hereby incorporated by reference in its entirety.

Other dissolvable materials 30 comprise composite energetic materials that can be deflagrated or detonated upon proper initiation. These energetic materials typically include an energetic resin and a reinforcement filler. Suitable energetic materials are described in greater detail, including methods of activation of these energetic materials, in U.S. Published Patent Application No. 2005/0281968 which is hereby incorporated by reference herein in its entirety.

Still other suitable dissolvable materials 30 are frangible materials such as non-metallic filamentary or fiber reinforced composite materials that are reducible to a fine particulate matter when subjected to an explosive force. Examples include, but are not limited to graphite reinforced epoxy or glass reinforced epoxy. Breaking or reducing the frangible materials into a fine particulate matter can be accomplished through any method or device known in the art, such as the use of an explosive charge and detonator operatively associated with the sacrificial material and a firing mechanism operatively associated with the detonator and explosive charge in a manner similarly described in U.S. Pat. No. 4,537,255 which is hereby incorporated by reference herein in its entirety or as described in U.S. Published Patent Application No. 2003/0168214 A1, which is also hereby incorporated by reference herein in its entirety.

Yet other suitable dissolvable materials 30 include "fusible materials" such as those that burn or combust due to a chemical reaction between fluid in the wellbore being exposed to the fusible material, such as water in the wellbore contacting the fusible material comprising one or more of potassium, magnesium, or sodium, or as a result of a temperature increase caused by the wellbore itself, or by friction being applied to the fusible material. One specific fusible material is PYROFUZE® available from Sigmund Cohn Corp. of Mount Vernon, N.Y. The PYROFUZE® fusible material consists of two metallic elements in intimate contact with each other. When the two elements are brought to the initiating temperature, or selected temperature increase, they alloy rapidly resulting in instant deflagration without support of oxygen. The reaction end products consist normally of tiny discreet particles of the alloy of the two metallic elements. Therefore, after the fusible material combusts, the area and volume in which fusible material was previous disposed becomes void thereby causing all or a portion of entry guide or profile of the entry guide to sufficiently disappear.

As mentioned above, guide 20 is not required to be formed completely out of dissolvable material 30. To the contrary, one or more portions of guide 20 can be formed out of non-dissolvable materials. For example, guide 20 may include one or more portions or pieces of one or more non-dissolvable materials that are held together by one or more dissolvable material 30. In these examples, the portions of dissolvable material 30 are dissolved, corroded, etc. or otherwise become compromised causing the guide 20 to break apart. Thus, while not all of guide 20 is "dissolved" or otherwise "disappears," it is sufficiently compromised such that guide 20 will not hinder subsequent operations. For example, in certain embodiments, guide 20 may become sufficiently compromised to permit access through bore 72 of tubing string 70 and bore 52 of downhole component 50 as discussed in greater detail below with respect to FIGS. 3-5.

Referring now to FIGS. 3-5, in one operation of the embodiment of FIGS. 1-2, entry guide 20 is attached to a lower end of tubing string 70 having tubing string bore 72. Tubing string 70 is run-in wellbore 60 to the desired depth to engage downhole component 50 having bore 52 (FIG. 3). Downhole component 50 can be any device or object located within wellbore 60 such as bridge plug, packer and the like.

Profile 29 of guide 20 contacts an upper end of downhole component 50 and guides tubing string 70 into bore 52 of downhole component 50 (FIG. 4). As a result, tubing string 70 is inserted into bore 52 of downhole component 50. Thereafter, all or part of guide 20 dissolves leaving behind tubing string 70 disposed within bore 52 of downhole component 50.

Although not required to be, dissolution of all or part of guide 20 can be accomplished by contacting guide 20 with a stimulus such as a corrosive fluid either already disposed in the wellbore, or pumped down the wellbore, or pumped down bore 72 of tubing string 70, which acts on dissolvable material 30 causing it to be compromised such as through dissolution, degradation, or other known mechanism due to the corrosive fluid contacting guide 20. Upon guide 20 being compromised, all or part of the inner diameter of bore 72 becomes unblocked. As illustrated in FIG. 5, the entire inner diameter of bore 72 of tubing string 70 is opened to the entire inner diameter of bore 52 of downhole component 50 (FIG. 5).

As noted above, not all of guide 20 is required to dissolve or "disappear" as those terms are used herein. For example, in certain embodiments, upper end 22 is the only portion of guide 20 formed of a dissolvable material 30. In these embodiments, upper end 22 dissolves thereby compromising the connection between guide 20 and tubing string 70, i.e., compromising threads 28. After being compromised, the remaining portion of guide 20 falls off tubing string 70.

In other embodiments, a central portion of body 21 around bore 26 is formed out of dissolvable material 30, however, outer wall surface 24 is formed out of a non-dissolvable materials. As a result, the diameter of bore 26 increases as the central portion dissolves. In certain of these embodiments, the diameter of bore 26 increases to the same diameter of bore 72 of tubing string 70.

It is to be understood that the invention is not limited to the exact details of construction, operation, exact materials, or embodiments shown and described, as modifications and equivalents will be apparent to one skilled in the art. For example, the dissolvable material can comprise combinations of one or more different dissolvable materials such as one that dissolves at a first rate and a second that dissolves at a second rate. In addition, the profile of the entry guide is not required to be uniformly shaped as shown in the embodiments of FIGS. 1-5, but can be asymmetrically shaped or have any other shape that facilitates guiding the tubing string into a location. Further, the entry guide is not required to be located at the lower end of the tubing string. Instead, the entry guide can be located above the lower end of the tubing string thereby facilitating tapered entry at a different location. Moreover, the bore of the entry guide can be larger at the upper end so that entry guide is fastened to the tubing string such as through inner threads disposed along the inner wall surface of the bore. Accordingly, the invention is therefore to be limited only by the scope of the appended claims.

What is claimed is:

1. An entry guide for attaching to a tubing string, the entry guide comprising:

a body having an upper end with at least one fastener member for securing the entry guide to a tubing string in a position that impedes fluid communication through the tubing string, and a lower end having a guide profile shaped to contact an upper end of a tool disposed within a wellbore and direct the entry guide into a bore of the tool, wherein a portion of the body comprises a dissolvable material configured to dissolve while secured to the tubing string and increase fluid communication through the tubing string for downhole operations through the bore of the tool disposed within the wellbore, the dissolvable material being an energetic material, a frangible material, a fusible material, or a fluidly degradable material.

2. The entry guide of claim 1, wherein the body further comprises a longitudinal bore in fluid communication with the upper end and the lower end.

3. The entry guide of claim 2, wherein the guide profile is comprised of the dissolvable material.

4. The entry guide of claim 3, wherein the guide profile comprises a uniform shape.

5. The entry guide of claim 4, wherein the uniform shape comprise a hemispherical shape.

6. The entry guide of claim 1, wherein an entirety of the body comprises the dissolvable material.

7. The entry guide of claim 1, wherein the guide profile comprises a uniform shape.

8. The entry guide of claim 7, wherein the guide profile is comprised of the dissolvable material.

9. The entry guide of claim 7, wherein the body further comprises a longitudinal bore in fluid communication with the upper end and the lower end, and wherein a portion of the body disposed around the longitudinal bore comprises the dissolvable material and an outer wall surface of the body is formed out of a non-dissolvable material so that a diameter of the longitudinal bore increases when the dissolvable material is dissolved.

10. The entry guide of claim 9, wherein the uniform shape comprise a hemispherical shape.

11. The entry guide of claim 1, wherein the at least one fastener member of the upper end of the body comprises the dissolvable material.

12. The entry guide of claim 11, wherein the at least one fastener member comprises threads.

13. The entry guide of claim 1, wherein the tool is one of a bridge plug and a packer.

14. A method of guiding a tubing string into a bore of a tool disposed within a wellbore, the method comprising the steps of:

(a) running a tubing string into a wellbore to a desired depth, the tubing string comprising an entry guide formed at least in part from a dissolvable material and having a profile to facilitate alignment of the tubing string with a tool disposed at the desired depth within a wellbore;

(b) contacting the profile of the entry guide with an upper end of the tool disposed at the desired depth within the wellbore;

(c) sliding the profile along the upper end of the tool until the tubing string is in alignment with a bore of the tool;

(d) inserting the entry guide and the tubing string into the bore of the tool; and (e) while the entry guide is connected to the tubing string, dissolving the dissolvable material through an application of temperature, pressure, contact with a fluid, combustion, or an explosion.

15. The method of claim 14, wherein during step (e), a portion of the entry guide breaks away from the tubing string.

16. The method of claim 15, wherein an upper end of the entry guide dissolves causing a connection of the entry guide to a lower end of the tubing string to be compromised so that the remainder of the entry guide is no longer disposed at the lower end of the tubing string.

17. The method of claim 14, wherein during step (e), an entirety of the entry guide dissolves.

18. The method of claim 14, wherein during step (e), an entirety of an inner diameter of a bore of the tubing string is placed in fluid communication with an entirety of an inner diameter of the bore of the tool.

19. The method of claim 14, wherein during step (e) an inner portion of the entry guide disposed around a longitudinal axis dissolves and an outer wall surface of the entry guide does not dissolve.

20. A method of guiding a tubing string into a bore of a tool disposed within a wellbore, the method comprising the steps of:

(a) running a tubing string along a portion of a wellbore above a tool disposed within the wellbore and toward the tool disposed within the wellbore, the tubing string comprising an entry guide formed at least in part from a dissolvable material and having a profile to facilitate alignment of the tubing string with the tool disposed within the wellbore, the tool having a bore with a smaller diameter than a diameter of the wellbore;

(b) contacting the profile of the entry guide with an upper end of the tool disposed within the wellbore;

(c) sliding the profile along the upper end of the tool until the tubing string is in alignment with a bore of the tool;

(d) inserting the entry guide and the tubing string into the bore of the tool;

(e) dissolving the dissolvable material through an application of temperature, pressure, contact with a fluid, combustion, or an explosion; and (f) performing downhole operations through a bore of the tubing string and through the bore of the tool after step (e).

* * * * *